US005238137A

United States Patent [19]

Cornwall

[11] Patent Number: 5,238,137

[45] Date of Patent: Aug. 24, 1993

[54] LONG-TERM STORAGE CONTAINER

[75] Inventor: Harry J. Cornwall, Long Beach, Calif.

[73] Assignee: Church of Spiritual Technology, Los Angeles, Calif.

[21] Appl. No.: 807,225

[22] Filed: Dec. 16, 1991

[51] Int. Cl.[5] ..... B65D 45/00

[52] U.S. Cl. ..... 220/327; 220/328; 220/408; 206/524.8

[58] Field of Search ..... 220/408, 327, 328; 206/524.8

[56] References Cited

U.S. PATENT DOCUMENTS

| | | | |
|---|---|---|---|
| 3,197,218 | 7/1965 | Coulter | 220/327 |
| 3,460,710 | 8/1969 | Vogeli | 220/327 |
| 3,599,825 | 8/1971 | Jorgensen | 220/327 |
| 3,943,987 | 3/1976 | Rossi | 206/524.8 |
| 4,066,401 | 1/1978 | Solomon | 206/524.8 |
| 4,091,919 | 5/1978 | MacLeod et al. | 206/524.8 |
| 4,398,649 | 8/1983 | Labbe | 220/327 |
| 4,524,729 | 6/1985 | Hill, Jr. et al. | 220/327 |
| 4,532,955 | 8/1985 | Squires | 220/327 |
| 4,589,564 | 5/1986 | Olster et al. | 220/327 |
| 4,664,281 | 5/1987 | Talk et al. | 220/327 |

*Primary Examiner*—Joseph Man-Fu Moy

[57] ABSTRACT

A long-term storage container including a box-like titanium receptacle having a titanium primary cover and sealed by a seal ring of malleable precious metal clamped between the cover and the receptacle, with titanium/ceramic valves in the cover for use in exhausting air from the receptacle and replacing it with argon gas, with titanium/precious metal back-up plugs sealing the valves after the air has been replaced. A titanium secondary cover is bonded to the receptacle by a titanium weld, reinforces the seal by the primary cover, and has a cuttable integral metal wall for ease of opening, and an inner titanium container is disposed in the receptacle with elongated, resiliently flexible ribs in its walls engaging similar ribs on the adjacent walls to provide cushioning against crushing and shocks.

29 Claims, 3 Drawing Sheets

LONG-TERM STORAGE CONTAINER

BACKGROUND OF THE INVENTION

This invention relates to storage containers and particularly to storage containers for holding one or more articles to be protected for very long periods of time. Such storage containers sometimes are referred to as time capsules.

To preserve materials and artifacts of the present such as documents, film, books, fine art, models and the like, for future generations and ages, special receptacles are stocked with such materials and artifacts and placed in special locations for protection until some future date when the receptacle is to be opened and its contents examined. Such receptacles typically are sealed to protect their contents from the distructive effects of moisture, and are stored in special vaults, or buried, for protection against physical damage by crushing, explosion or the like.

The basic requirements for such a container are that it be physically strong, air-tight, waterproof, and made from materials that will not cause damage to the contents. Materials used for the containers typically are copper, aluminum, stainless steel or plastic and the containers are provided with seals or gaskets, or are welded closed, for air- and water-tightness.

Unfortunately, apart from stainless steel, metals that have been used are subject to a relatively high level of corrosion over time, including electrolysis and rust, and plastics either deteriorate or release acids or other damaging chemicals into the container over long periods of time, or become waterpermeable. Further, conventional seal materials also deteriorate with time, losing their resilience and water-tightness. Conventional soldering and welding materials either deteriorate or introduce contaminants into the container, so seals formed by soldering and welding have disadvantages.

The foregoing prior approaches to the art of preparing time capsules have resulted in serviceable but less-than-optimum long-term storage containers. The objective of this invention is to provide a substantially improved storage container that is capable of increasing the protection of materials and artifacts for substantially greater periods of time.

SUMMARY OF THE INVENTION

The present invention provides an improved long-term storage container in which all of the components are composed of highly durable and heat- and corrosion-resistant materials and are tightly sealed in a manner that will remain effective for much longer than has been the case in the past, probably for thousands of years. The structure of the container provides physical protection against shock and crushing, avoids electrolysis and contamination of the interior by its components, and permits the ready substitution of an inert atmosphere for the original atmosphere of the container, air, after the articles to be stored are in place. All of this significantly increases the degree and duration of protection provided by the container.

More specifically, and as illustrated by the preferred embodiment shown herein, the present invention comprises an outer storage container including a receptacle and a cover composed of the same highly corrosion-resistant and relatively strong metal, preferably stainless steel or titanium, and sealed by a highly corrosion-resistant and very malleable metal seal, preferably one of the precious metals—gold, platinum or silver—clamped between the cover and the receptacle. Replacement of the gaseous atmosphere is accomplished through at least one valve having a body composed of the corrosion-resistant metal and a closure member of inert material, preferably ceramic, sealed after use by a corrosion resistant back-up plug, preferably with a precious metal seal. Additional sealing protection is provided by a secondary cover of the same corrosion-resistant metal which overlies the primary cover and has a flange that is bonded to the receptacle by an external welded seal, also of corrosion-resistant material, the flange having a thin-wall section that can be cut with a sharp knife for removal of the secondary cover without breaking the welded seal. Extra physical protection is provided by an inner container smaller than the outer container and disposed within the latter with special cushioning means between the two, herein sets of resiliently flexible internal protrusions on the outer container and external protrusions on the inner container, in abutting engagement between the containers. The illustrative inner container is titanium and the protrusions are sets of parallel ribs of arcuate cross-sectional shape disposed substantially at right angles to each other. Non-reactive archival storage paper also may be used for the inner container, and may be used to separate metal parts from each other.

Other features and advantages of the invention will become apparent from the following detailed description, taken in conjunction with the accompanying drawings.

DETAILED DESCRIPTION OF THE PRESENTLY PREFERRED EMBODIMENT

Figure 1:
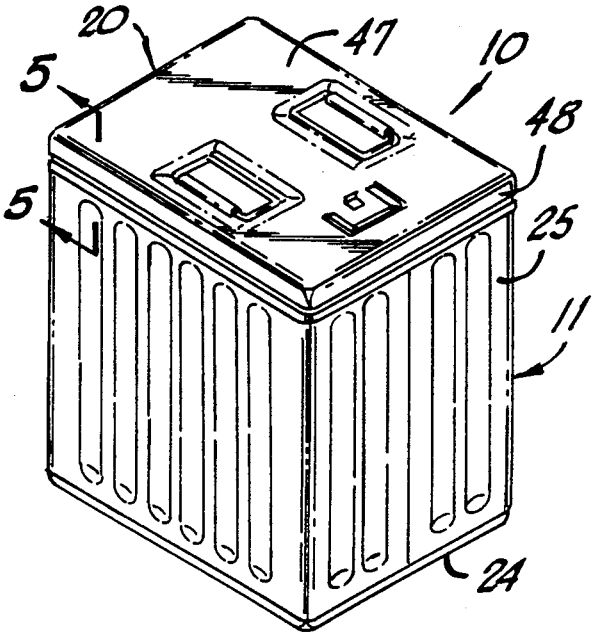
FIG. 1 is a perspective view of a long-term storage container embodying the novel features of the present invention.
Figure 2:
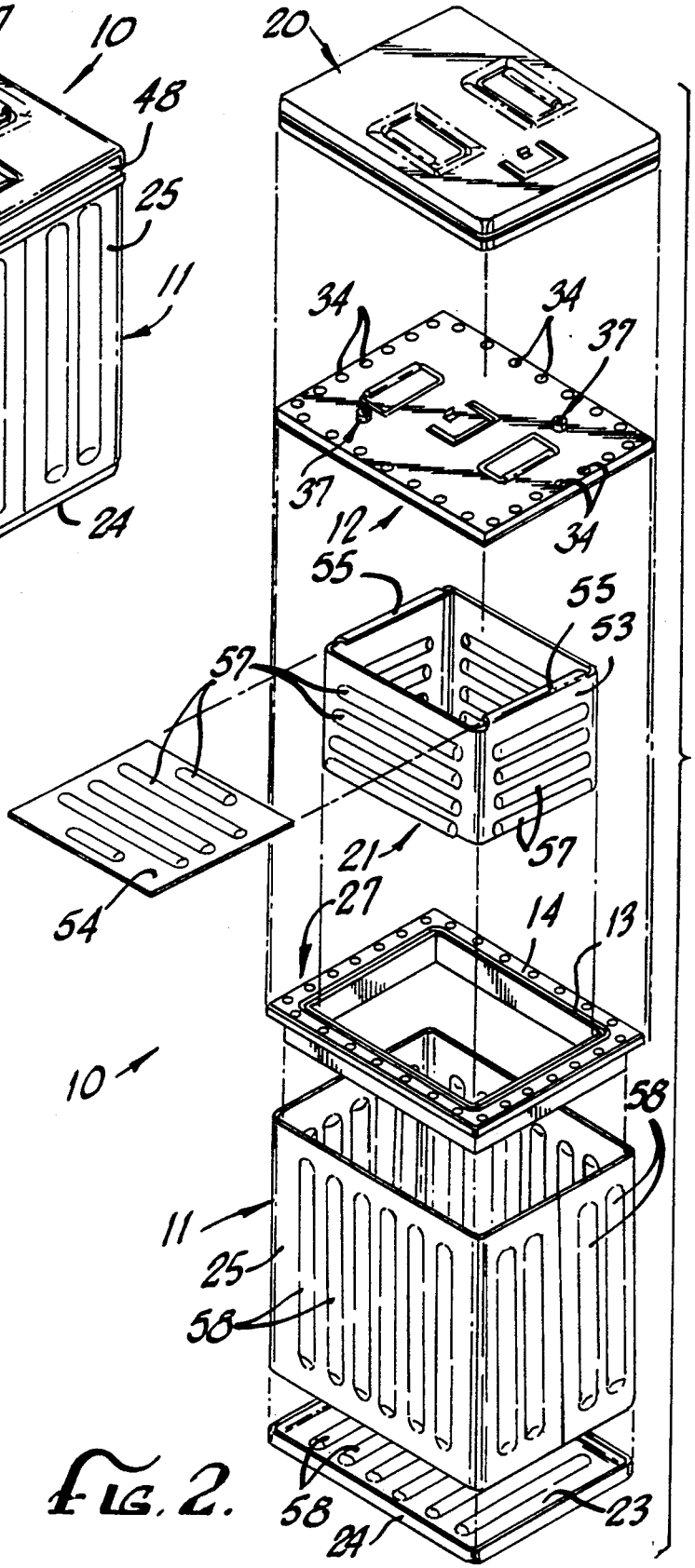
FIG. 2 is an exploded perspective view of the storage container of FIG. 1.

As shown in the drawings for purposes of illustration, the invention is embodied in a long-term storage container, indicated generally by the reference number 10 in FIGS. 1 and 2, for holding and protecting one or more articles (not shown) over a long period of time. The illustrative storage container basically comprises an outer storage receptacle 11 and a cover 12 for the receptacle, both composed of the same relatively strong and highly corrosion-resistant metal to provide structural protection and to avoid damage from corrosion or electrolysis, and a seal between the cover and the receptacle formed by a seal ring 13 composed of highly corrosion-resistant and very malleable metal that is clamped between opposed sealing surfaces 14 and 15 of the receptacle and the cover, herein by means of a series of headed fasteners 17 (FIG. 5) extending through holes 18 in the cover and secured to the receptacle. The fasteners are bolts threaded into holes 19 in the sealing surface 14. A secondary cover 20 provides extra sealing protection for the container 10, and a second, inner container 21 provides extra physical protection for articles in the container, both the secondary cover and the inner container being composed of the same corrosion-resistant metal as the outer receptacle 11 and its cover 12, or a non-reactive material such as archival storage paper.

The preferred material for the outer and inner containers is material selected from the group consisting of stainless steel and titanium, both of which have the desired heat and corrosion resistance and strength. Titanium is used in the preferred embodiment of the invention. The preferred material for the seal ring 13 is a material selected from the group consisting of gold, platinum and silver (ninety-nine percent pure or fine silver), which have the necessary malleability and corrosion resistance. Silver is used in the preferred embodiment.

Figure 3:
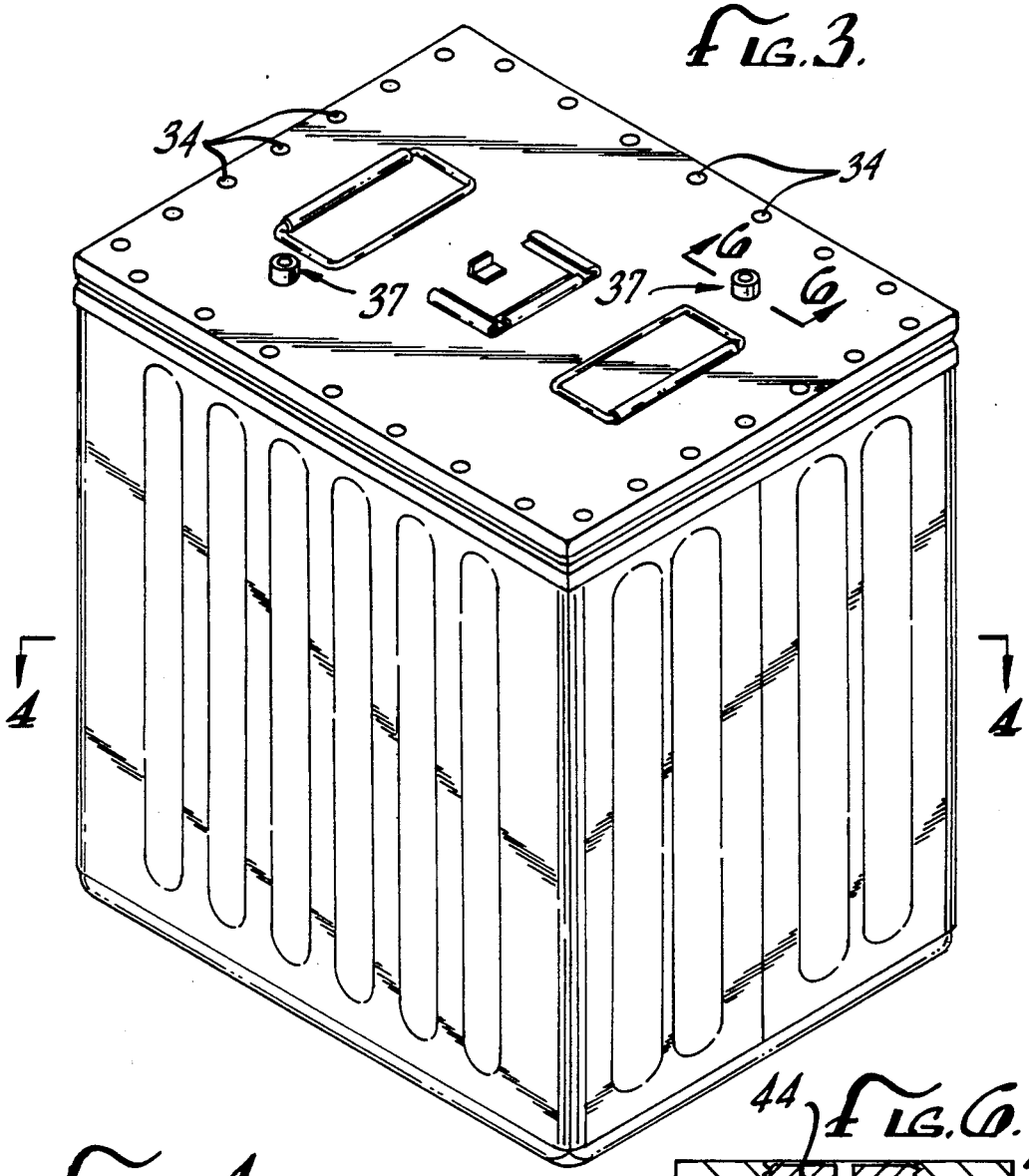
FIG. 3 is an enlarged perspective view of the storage container of FIG. with the secondary cover removed.

As best seen in FIGS. 2 and 3, the outer storage receptacle 11 is formed in three pieces, a dished titanium bottom wall 23 that is rectangular for the preferred rectangular box-like container with an upturned, integral side flange 24 around its periphery, a sidewall 25 and a top rim 27. The sidewall 25 is formed in one piece, as an elongated titanium panel that is bent into a rectangular shape, wrapped around the bottom wall and bonded together at its ends with a weld, a titanium weld in the preferred embodiment.

Figure 5:
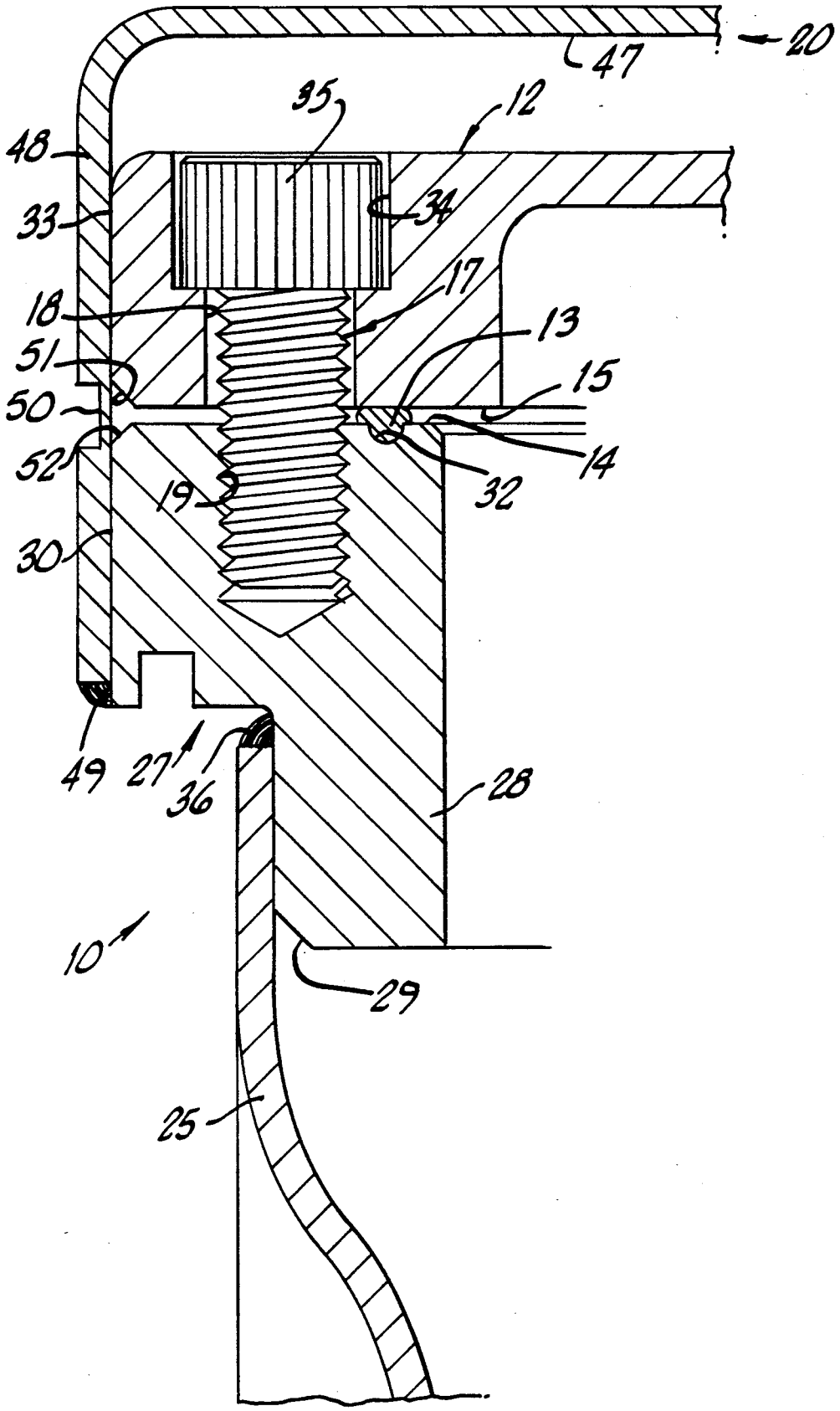
FIG. 5 is a greatly enlarged fragmentary cross-sectional view taken along the line 5—5 of FIG. 1.

The top rim 27, shown in FIGS. 2 and 5, is rectangular in shape and has a depending neck 28 that is fitted tightly inside the sidewall 25, with an interference fit facilitated by a beveled outer corner 29 (FIG. 5) of the neck, an outer side 30 offset outwardly from the sidewall, and a top side 24 that faces upwardly toward the cover 12 and forms the sealing surface of the receptacle 11. A continuous seal groove 32 is formed in this surface and surrounds the opening into the receptacle that is defined by the rim, and the series of threaded bolt holes 19 is formed in this surface, spaced outwardly from the seal groove 32, on the side thereof opposite the opening into the receptacle. A continuous titanium weld 36 (FIG. 5) is applied between the neck 28 and the sidewall 25 to insure a tight seal.

The primary cover 12 is formed as a one-piece plate of the same size and exterior shape as the rim 27, and overlies the latter with its outer side 33 aligned with the outer side 30 of the rim. The clamping bolts 17 extend through the holes 18, which are closely spaced in a series around the periphery of the cover and preferably have countersunk outer ends 34 for heads 35 on the bolts, and are threaded into the holes 19 in the rim.

It will be seen in FIG. 5 that the seal ring 13 (which originally is substantially circular in cross-section) has a larger cross-sectional area than the seal groove 32, so as to extend substantially above the top surface of the rim after being pressed and deformed into the groove by the clamping action of the bolts 17. This leaves the cover and the rim spaced apart as shown in FIG. 5, with the space securely sealed by the seal ring.

Figure 6:
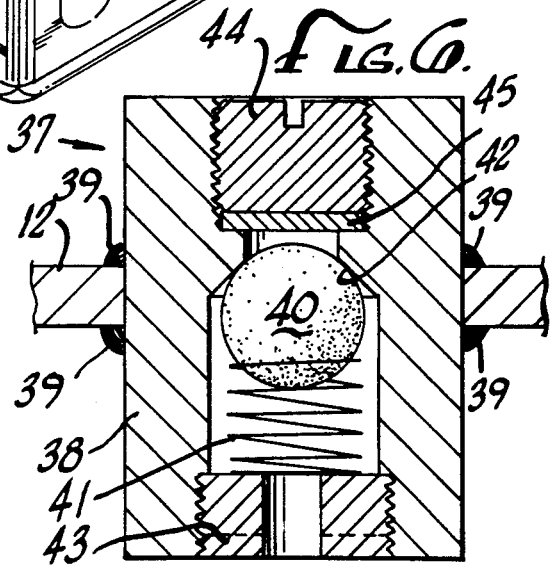
FIG. 6 is a greatly enlarged fragmentary cross-sectional view taken along the line 6—6 of FIG. 3.

Substitution of an inert atmosphere for the original atmosphere in the container 10 is accomplished by means of one or more valves 37 (FIGS. 2, 3 and 6) that permit evacuation of the original atmosphere and insertion of an inert gas, preferably argon, and thereafter maintain a tight seal for the container. As best seen in FIG. 6, each valve comprises a body 38 held in the cover 12 by titanium welds 39, a corrosion-resistant closure herein in the form of a ceramic ball 40, a titanium spring 41 inwardly from the ball urging it yieldable against a seat 42, and a titanium inner plug 43 loading the spring and having a central passage to the interior. With the ball held open from the outside, the original atmosphere is exhausted and the argon gas is inserted. After the ball is released, an outer back-up plug 44, also of titanium, and a precious metal seal 45 are inserted in the cover to back up the valve and provide back-up seals in the cover. Two such valves 37 are included in the illustrative storage container.

The titanium secondary cover 20 is formed in one piece and has a flat top wall 47 spaced above the primary cover 12 and an integral depending flange 48 which is long enough to extend across the outer sides 30 and 33 of the primary cover and the receptacle rim 27. This flange is sized and shaped for tight-fitting engagement with these sides, and is bonded to the rim by a titanium weld 49 (FIG. 5), which securely seals the secondary cover in place. To eliminate air from the secondary cover, it preferably is filled with argon gas in an inverted position before being assembled in an inverted position, argon gas being heavier than air.

To facilitate eventual removal of the secondary cover 20 without danger of damage to the contents of the storage container 10, a thin-wall section 50 is formed in the flange 48 above the weld 49, with a reduced thickness of titanium thin enough to be cut with a sharp tool such as a knife (not shown). This section can be formed by removing metal from the outside in a milling operation, forming an external groove in the flange, leaving a reduced thickness of metal that is preferably less than one millimeter, and as thin as 250 micrometers. As shown in FIG. 5, the thin-wall section is aligned with an internal groove inside the flange, formed by two beveled edges 51 and 52 on the primary cover 12 and the receptacle rim 27. This provides clearance for the cutting tool.

Figure 4:
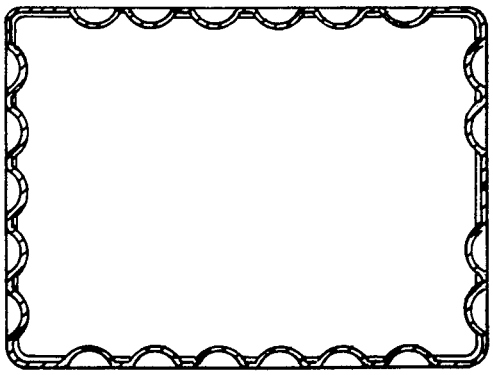
FIG. 4 is a cross-sectional view taken along line 4—4 of FIG. 3, shown on a reduced scale.

The illustrative inner protective container, indicated generally by the number 21, is shown in FIGS. 2 and 4 and comprises a box-like inner receptacle 53 having an open upper side, and a cover 54 in the form of a plate that is slidable into a closed position on top of the inner receptacle, being held in place thereon by two guides 55 that are bent to curve over the opposite edges of the cover and retain it loosely in place on the receptacle. No sealing is required of this cover, since its function is to provide only structural protection for the contents of the storage container 10. This inner container may be titanium or other non-reactive material.

For this purpose, the inner container 21 is made smaller than the outer receptacle 11, and cushioning means are provided around the inner container, herein in the form of outwardly projecting resiliently flexible protrusions 57 formed integrally with the walls and cover of the inner container and inwardly projecting, resiliently flexible protrusions 58 formed integrally with the sidewall and the bottom wall of the outer receptacle 11. As shown in FIGS. 2 and 4, these protrusions 57 and 58 are elongated ribs of arcuate cross-sectional shape, herein substantially semi-circular, that extend substantially the full lengths of the walls in which they are formed, and two shorter ribs 59 in the inner cover 54. The ribs of the various sets are parallel to each other, and are arranged at angles, preferably of about ninety degrees, with the ribs of the opposing sets. The ribs 57 and 59 of the inner cover abut against the underside of the outer cover 12. When deformed out of relatively thin sheet metal, such as titanium 0.080 of an inch thick, the ribs have sufficient resilient strength to provide good cushioning protection for the contents. Additional special fixtures (not shown) may be provided inside the inner container to receive and hold the articles to be protected.

From the foregoing, it will be evident that the present invention provides an effective long-term storage container for use as a time capsule that will preserve articles for a long period of time, extending into the thousands of years. It also will be apparent to those skilled in the art that the use of titanium or stainless steel containers filled with inert gas and sealed with a malleable precious metal seal will provide high heat resistance as well as corrosion resistance. It also will be evident that, while one specific embodiment has been shown and described in detail, various modifications and changes may be made by those skilled in the art within the spirit and scope of the invention.

I claim:

1. A long-term storage container for use as a time capsule, comprising:

a box-like titanium receptacle having an open top side surrounded by a continuous rim, said rim having a flat top surface formed with a continuous seal groove therein;

a primary titanium cover for said receptacle having a bottom sealing surface overlying said top surface;

a seal ring of corrosion-resistant and malleable precious metal disposed partially in said seal groove and engaging said top and bottom surfaces;

bolts extending through said primary cover and threaded into said rim and clamping the cover in sealed relation with said receptacle;

at least one one-way valve in said cover composed of titanium and having a ceramic closure ball movable into an open position for evacuation of the receptacle and introduction of inert gas, and normally tightly closed;

a back-up seal for said valve comprising a plug composed of titanium and a precious metal seal held in place in said valve by said plug;

a one-piece secondary titanium cover overlying the primary cover and having an integral depending flange tightly surrounding the primary cover and said rim and bonded to said rim by a titanium weld, said flange having a thin-wall section cuttable with a knife for removal of the secondary cover;

and an inner titanium container in said receptacle, said inner container having walls with outwardly extending, elongated and resiliently flexible ribs thereon;

said receptacle having walls with inwardly extending elongated and resiliently flexible ribs thereon engageable with the ribs on the inner container to cushion the latter.

2. A long-term storage container, comprising:

an outer storage receptacle composed of a selected corrosion-resistant metal and having a sidewall, a bottom wall, an open side opposite said bottom wall, and a continuous rim extending around said open side and defining the opening into the open side of the receptacle;

said rim having a neck fitted inside said sidewall with a tight, sealing fit, an outer side, a flat, planar top side facing away from said bottom wall, and a continuous seal groove in said top side extending around said opening;

a sealing cover for said outer storage receptacle composed of said selected metal and having a flat, planar bottom side overlying the top side of said rim, and an outer side of the same size and shape as the outer side of the receptacle;

a continuous seal ring composed of highly corrosion-resistant and malleable metal having an underside disposed in said seal groove, said seal ring extending above said seal groove and engaging the bottom side of said cover to maintain a space between the cover and the rim;

a plurality of fasteners extending through said cover and secured to said rim between said seal ring and said outer sides and tightened to clamp and deform said seal ring between said cover and said rim, therefore tightly sealing the interior of said receptacle;

valve means on said container for evacuating the gas atmosphere from said container and replacing that atmosphere with inert gas;

an inner container formed entirely of corrosion-resistant material for holding the protected article within the storage container, comprising an inner receptacle smaller than said storage receptacle and an inner cover removably mounted on said inner receptacle; and cushioning means between said inner and outer containers for protecting the inner container within the outer container.

3. A long-term storage container as defined in claim 2 further including an outer protective cover for said storage container, said protective cover being composed of said selected material and comprising a top wall overlying said sealing cover, a continuous peripheral depending flange engaging the outer sides of said sealing cover and said rim and sealed to the latter, said flange having a thin-wall section aligned with the space between the sealing cover and the rim, capable of being cut by a sharp tool for removal of the protective cover.

4. A long-term storage container as defined in claim 2 wherein the corrosion-resistant metal is selected from the group consisting of stainless steel and titanium.

5. A long-term storage container as defined in claim 2 wherein the depending flange is sealed to the rim by a weld of corrosion-resistant metal.

6. A long-term storage container as defined in claim 2 wherein said valve means comprise a one-way valve having a body composed of the same material as said cover and said receptacle, a closure member of inert material, and a spring urging said closure member into a closed position, whereby said atmosphere can be evacuated and replaced with said closure member held open from the exterior.

7. A long-term storage container as defined in claim 6 wherein said closure member is a ceramic ball.

8. A long-term storage container as defined in claim 2 further including a back-up seal for said valve means, including a plug composed of the same material as said cover, and a precious metal seal held in place by said plug.

9. A long-term storage container as defined in claim 2 wherein said cushioning means between said inner and outer containers comprise resilient external protrusions on said inner container and resilient internal protrusions on said storage receptacle abutting against each other between the inner container and the storage receptacle.

10. A long-term storage container as defined in claim 2 wherein the corrosion-resistant and malleable metal of said seal ring is selected from the group consisting of gold, platinum and silver.

11. A long-term storage container as defined in claim 2 wherein the interior space of said storage container is filled with inert gas.

12. A long-term storage container as defined in claim 10 wherein said gas is argon.

13. A long-term storage container, comprising:

an outer storage receptacle composed of a selected corrosion-resistant metal and having a sidewall, a bottom wall, an open side opposite said bottom wall, and a continuous rim extending around said open side and defining the opening into the open side of the receptacle, said rim having a neck fitted inside said sidewall with a tight, sealing fit, an outer side, a flat, planar top side facing away from said bottom wall, and a continuous seal groove in said top side extending around said opening;

a sealing cover for said outer storage composed of said selected metal and having a flat, planar bottom side overlying the top side of said rim, and an outer side of the same size and shape as the outer side of the receptacle;

a continuous seal ring composed of a highly corrosion-resistant and malleable metal selected from the group consisting of gold, platinum and silver having an underside disposed in said seal groove, said seal ring having a larger cross-sectional area than the seal groove and extending above said seal groove and engaging the bottom side of said cover to maintain a space between the cover and the rim;

a plurality of fasteners extending through said cover and secured to said rim between said seal ring and said outer sides and tightened to clamp and deform said seal ring between said cover and said rim, therefore tightly sealing the interior of said receptacle; and valve means on said container for evacuating the gas atmosphere from said container and replacing that atmosphere with inert gas.

14. A long-term storage container for holding an article to be protected, comprising:

an outer storage receptacle composed of highly corrosion-resistant and relatively strong metal selected from the group consisting of stainless steel and titanium and having an open side surrounded by a first continuous sealing surface;

a cover for said outer storage container composed of the same highly corrosion-resistant metal and having a second continuous sealing surface positioned alongside but spaced from said first surface when the container is closed;

a continuous, solid seal ring composed of highly corrosion-resistant and malleable metal disposed between said first and second surfaces and wherein one of said sealing surfaces has a continuous seal groove therein and said seal ring has a greater cross-sectional area than the seal groove;

and means for clamping said sealing surfaces against said seal ring to deform the latter into tight sealing engagement with said surfaces, whereby the seal ring extends out of the groove to engage the other sealing surface after being clamped and deformed.

15. A long-term storage container as defined in claim 14 wherein the corrosion-resistant and malleable metal of said seal ring is selected from the group consisting of gold, platinum and silver.

16. A long-term storage container as defined in claim 14 further including valve means on said container for exhausting the gaseous atmosphere from the interior of the container and replacing that atmosphere with an inert gas and thereafter maintaining the interior sealed, said valve means comprising a one-way valve having a body composed of the same material as said cover and said receptacle, a closure member of inert material, and a spring urging said closure member into a closed position, whereby said atmosphere can be evacuated and replaced with said closure member held open from the exterior.

17. A long-term storage container as defined in claim said closure member is a ceramic ball.

18. A long-term storage container as defined in claim 16 further including a back-up seal for said valve means, including a plug composed of the same material as said cover, and a precious metal seal held in place by said plug.

19. A long-term storage container as defined in claim 17 wherein said receptacle is an open-sided box having a continuous rim surrounding said open side and having a flat end surface forming said first sealing surface, and said cover overlies said rim, said means for clamping said sealing surfaces against said seal ring comprising headed fasteners composed of the same corrosion-resistant material as said cover and said receptacle, said fasteners extending through said cover and being threaded into said rim.

20. A long-term storage container as defined in claim 14 further including an inner container disposed in said storage receptacle and comprising an inner receptacle smaller than said storage receptacle and an inner cover on said inner receptacle, said inner container being smaller than said storage receptacle; and further including resiliently yieldable abutting means between the inner container and the outer container for holding the inner container firmly in place and yielding to cushion external shocks on the storage container.

21. A long-term storage container as defined in claim 20 wherein said resiliently yieldably abutting means comprise resilient external protrusions on said inner container and resilient internal protrusions on said storage receptacle abutting against each other between the inner container and the storage receptacle.

22. A long-term storage container as defined in claim 21 wherein said internal and external protrusions are sets of elongated, generally parallel ribs of arcuate cross-sectional shape disposed at angles to each other.

23. A long-term storage container as defined in claim 14 wherein said receptacle has a sidewall, and a continuous rim defining said open side with a neck telescoped tightly into said sidewall, all composed of said corrosion-resistant metal, and further including a continuous weld of said corrosion-resistant metal joining said neck to said sidewall.

24. A long-term storage container for holding an article to be protected, comprising:

an outer storage receptacle composed of highly corrosion-resistant and relatively strong metal and having an open side surrounded by a first continuous sealing surface;

a cover for said outer storage container composed of the same highly corrosion-resistant metal and having a second continuous sealing surface positioned alongside said first surface when the container is closed;

a continuous seal ring composed of highly corrosion-resistant and malleable metal disposed between said first and second surfaces; and a secondary cover for said receptacle overlying the first-mentioned cover and having a continuous flange telescoping over the first cover and the receptacle, said secondary cover being composed of the same material as the first cover and the receptacle and said flange being joined to the receptacle by a continuous external seal bonded to said flange and said receptacle.

25. A long-term storage container as defined in claim 24 wherein the space in said container, including the secondary cover, is filled with inert gas.

26. A long-term storage container as defined in claim 24 wherein said external seal is a weld composed of highly-corrosion-resistant welding material.

27. A long-term storage container as defined in claim 24 wherein said weld is a weld made with pure titanium.

28. A long-term storage container as defined in claim 24 further including means forming a peripheral external groove extending around said flange and forming a weakened, thin-wall section of said flange, and means forming a peripheral internal groove in the container inside the flange in general alignment with the external groove, said thin-wall section being sufficiently thin to be cut with a sharp tool for removal of the second cover without breaking said external seal.

29. A long-term storage container as defined in claim 28 wherein said internal and external grooves are aligned with said first and second sealing surfaces, and said internal groove is defined by relieved edges on said first and second sealing surfaces.

* * * * *

UNITED STATES PATENT AND TRADEMARK OFFICE

CERTIFICATE OF CORRECTION

PATENT NO. : 5,238,137

DATED : August 24, 1993

INVENTOR(S) : Harry J. Cornwall

It is certified that error appears in the above-indentified patent and that said Letters Patent is hereby corrected as shown below:

Column 2, line 41, FIG. 3, after the word "FIG" insert --1--.
Column 3, line 34, after "top side" delet 24 and insert --14--therefor;
Column 8, claim 17, at the end of the first line, after word "claim" insert --16--.

Signed and Sealed this

Seventh Day of June, 1994

*Attest:*

Bruce Lehman

BRUCE LEHMAN

*Attesting Officer*

*Commissioner of Patents and Trademarks*